US006296501B1

(12) United States Patent
Ray et al.

(10) Patent No.: US 6,296,501 B1
(45) Date of Patent: Oct. 2, 2001

(54) ELECTRIC CABLE GROUNDING PIERCER

(75) Inventors: Wayne Ray, Leesburg; Walter M. Herod, Mt. Dora, both of FL (US); Charles E. Webb, 2030 Ponderosa Pl., Mandeville, LA (US) 70448

(73) Assignee: Charles E. Webb, Manderville, LA (US)

( * ) Notice: Subject to any disclaimer, the term of this patent is extended or adjusted under 35 U.S.C. 154(b) by 0 days.

(21) Appl. No.: 09/427,952

(22) Filed: Oct. 27, 1999

(51) Int. Cl.[7] ..... H01R 4/60; H01R 4/64
(52) U.S. Cl. ..... 439/197; 30/366; 30/361
(58) Field of Search ..... 439/197, 416, 439/425, 477, 478; 30/366, 362, 361, 90.1

(56) References Cited

U.S. PATENT DOCUMENTS

| | | | | |
|---|---|---|---|---|
| 2,578,582 | | 12/1951 | Northcutt | 30/92 |
| 2,823,454 | | 2/1958 | Kirchner | 30/228 |
| 3,177,584 | | 4/1965 | Cockerill | 30/228 |
| 3,594,703 | * | 7/1971 | Holtzapple | 439/416 |
| 3,840,987 | | 10/1974 | Netta | 30/90.1 |
| 3,860,316 | * | 1/1975 | Hardesty | 439/425 |
| 4,026,028 | | 5/1977 | Green | 30/233 |
| 5,063,670 | | 11/1991 | Eberhardt et al. | 30/228 |
| 5,125,158 | | 6/1992 | Casebolt et al. | 30/228 |
| 5,711,078 | | 1/1998 | Patton et al. | 30/228 |

* cited by examiner

*Primary Examiner*—Brian Sircus
*Assistant Examiner*—Javaid Nasri
(74) *Attorney, Agent, or Firm*—Edward M. Livingston, Esq.

(57) ABSTRACT

An electric-cable-grounding piercer has a piercer blade (1) with a trunk end attached to a double-acting hydraulic piston (2) in a double-acting hydraulic cylinder (3) from which a blade housing (4) is extended from a blade end. An insertion-pressure tube (7) is positional in fluid communication intermediate an insertion-pressure end of the double-acting hydraulic cylinder and a pump-outlet conveyance (36) from a hydraulic pump (9). A withdrawal-pressure tube (10) is positional in fluid communication intermediate a withdrawal-pressure end of the double-acting hydraulic cylinder and the outlet conveyance from the hydraulic pump. The hydraulic pump has a control valve (35) for directing pressurized hydraulic fluid to the insertion-pressure end and to the withdrawal-pressure end of the double-acting hydraulic cylinder selectively. The piercer blade has electrical communication with electric cable (6) being pierced for transmission to a ground-line connector (12) to which a ground line (13) is connectable for releasing residual current from the electric cable in preparation for work on the electric cable. An insertion-depth indicator (44) attached to the piercer blade is visible through an indicator slot 45 in the blade housing. A cable attachment, such as a chain clamp (5), is positioned on a cable end of the blade housing for rigid attachment to the cable to be pierced.

20 Claims, 5 Drawing Sheets

ELECTRIC CABLE GROUNDING PIERCER

BACKGROUND OF THE INVENTION

This invention relates to piercing electrical cable with an electrically grounding blade from which a ground line releases residual electrical current from high-power electrical lines in order to protect electrical workers from electrocution before proceeding with work such as line-splicing the electrical cable.

Currently, round spikes with ground wire attached are forced with various means into high-power electrical cable to release residual electrical current before electrical work is done on the cable. The spikes are handled manually with insulated gloves while being driven into and pulled out of electrical cables. This is dangerous, time-consuming, difficult and fatiguing.

There is no known mechanized means for ground-piercing electrical cable in a manner taught by this invention. The nearest known prior art relates not to mechanized cable grounding but to mechanized cutting of cable and other elongate objects.

Examples of known mechanized cutters which are most closely related but different from this mechanized electric-cable-grounding piercer are described in the following patent documents. U.S. Pat. No. 5,711,078, issued to Patton, et al. on Jan. 27, 1998, described a cutting and crimping tool that was hydraulically operated linearly. U.S. Pat. No. 5,125,158, issued to Casebolt, et al. on Jun. 30, 1992, described a portable cutting and shearing tool having a guillotine cutter operated hydraulically. U.S. Pat. No. 5,063,670, issued to Eberhardt, et al. on Nov. 12, 1991, described a rescue tool for cutting steering-wheel rods and other rods from people pinned down by them in accidents. U.S. Pat. No. 4,026,028, issued to Green on May 31, 1977, described yet another cable cutter that is fluid-pressure operated but different than some of the others, had unique opposing blade cutting. Lastly, U.S. Pat. No. 2,823,454, issued to Kirchner on Feb. 18, 1958, described another guillotine cable cutter with hydraulic operation.

SUMMARY OF THE INVENTION

Objects of patentable novelty and utility taught by this invention are to provide an electric-cable-grounding piercer which:

- has bidirectionally double-acting hydraulic actuation with high pressures of optionally up to 10,000 psi (five tons) for inserting a grounding blade into and for withdrawing the grounding blade out from all sizes of high-power electrical cable;
- has double-chain clamping for reliable, fast and convenient attachment to high-pressure cable;
- has quick-and-easy bolting attachment of a grounding line to electrical grounding communication with the grounding blade;
- provides a selection of sizes of machined attachments to cables with outside diameters of up to three-and-three-eighths inches;
- has a grounding blade with a width of preferably up to one-and-one-half inches and a linear travel of three-and-one-eighth inches in both directions to assure electrical-contact piercing into and disconnecting withdrawal from all conductors in single-or multiple-conductor cable; and
- has a visual depth indicator for inspection to assure depth of insertion into and completeness of withdrawal from electrical cables.

This invention accomplishes these and other objectives with an electric-cable-grounding piercer having a piercer blade with a trunk end attached to an output shaft of a double-acting hydraulic piston in a double-acting hydraulic cylinder from which a cable attachment is extended from a blade end. An insertion-pressure tube is in hydraulic-fluid communication intermediate a hydraulic pump and an insertion-pressure end of the double-acting hydraulic cylinder. A withdrawal-pressure tube is in hydraulic-fluid communication intermediate the hydraulic pump and a withdrawal-pressure end of the double-acting hydraulic cylinder. The hydraulic pump has a control valve for directing pressurized hydraulic fluid to the insertion-pressure end and to the withdrawal-pressure end of the double-acting hydraulic cylinder selectively. The piercer blade has electrical contact with a ground bolt to which a ground line is connectable for releasing residual current from an electric cable being pierced. A depth indicator attached to the piercer blade is visible through a slot in a blade housing.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figures 1, 2:
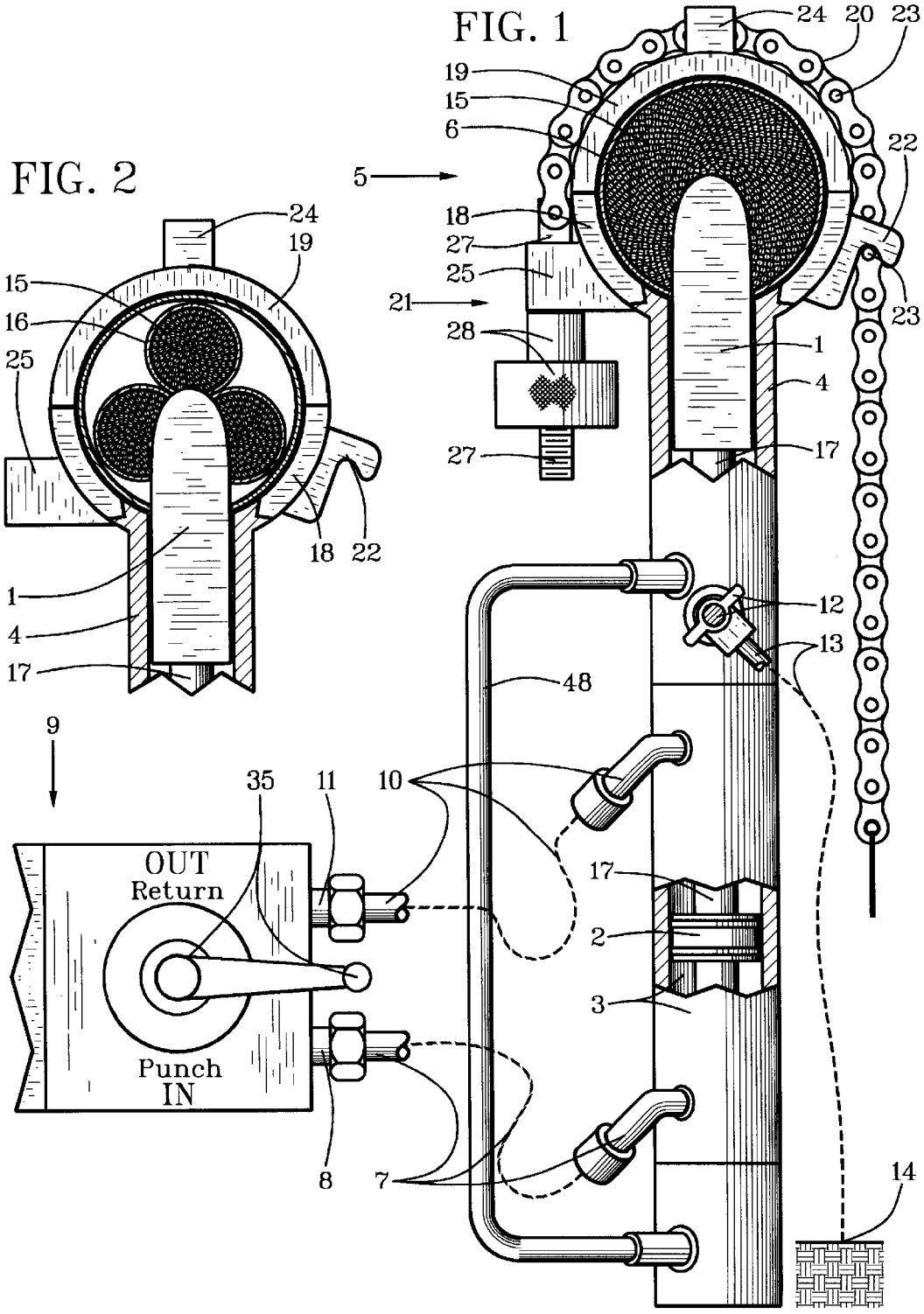
FIG. 1 is a partially cutaway elevation view from a piercer side of the electrical-cable-grounding piercer with a hydraulic piston at a central position between ends of travel and with a piercer blade accordingly at a central position of travel through an electric cable that is held by a chain type of cable clamp.
FIG. 2 is a partially cutaway front view of a multiple-line cable in relationship to a piercer blade.
Figure 3:
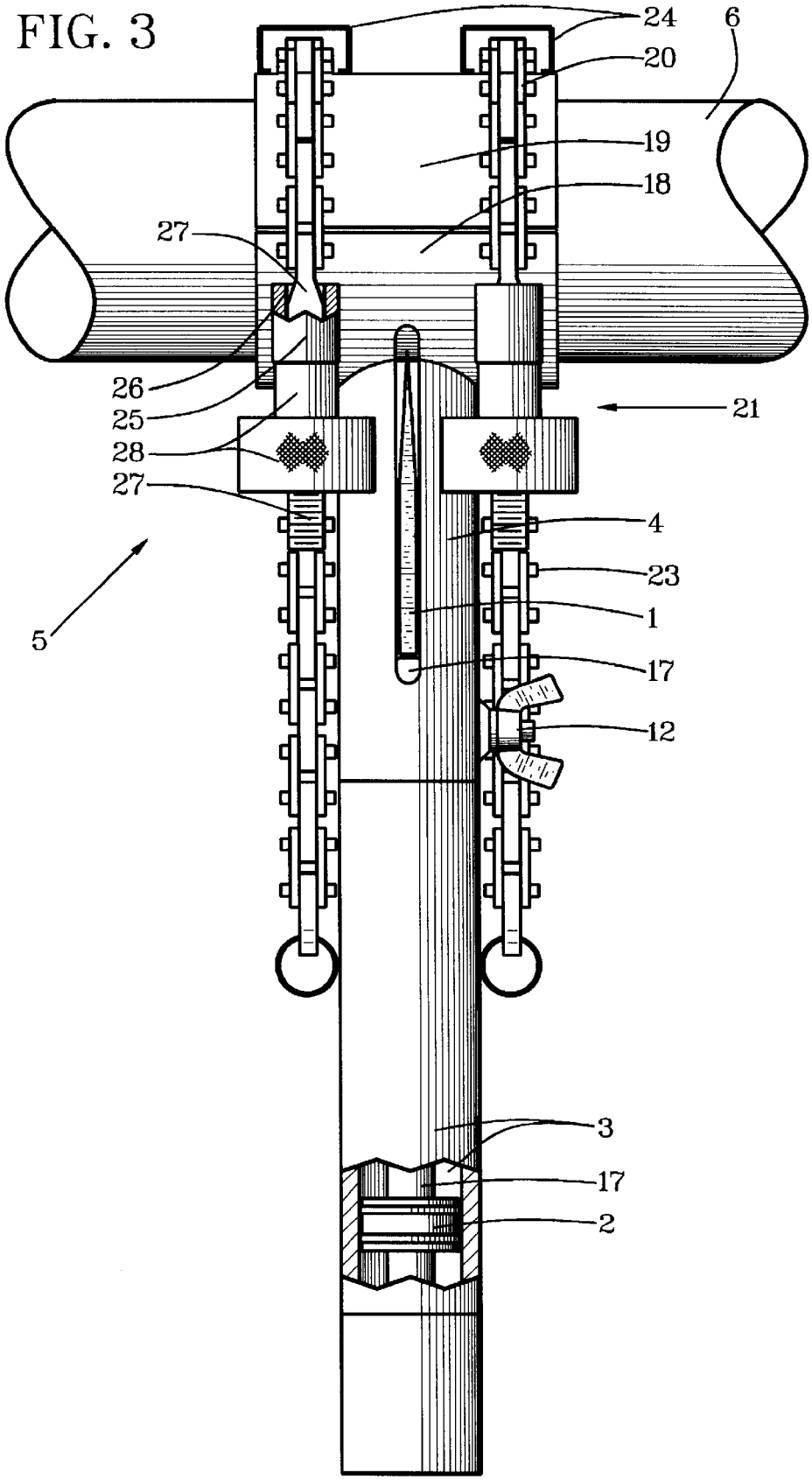
FIG. 3 is a partially cutaway elevation view of a right side of the electrical-cable-grounding piercer with a hydraulic piston proximate a bottom end of travel and with the piercer blade accordingly proximate a bottom position prior to travel through the electric cable that is shown from a side while being held by the cable clamp.

Listed numerically below with reference to the drawings are terms used to describe features of this invention. These terms and list numbers assigned to them designate the same features throughout this description.

1. Piercer blade
2. Double-acting hydraulic piston
3. Double-acting hydraulic cylinder
4. Blade housing
5. Chain clamp
6. Electric cable
7. Insertion-pressure tube
8. Insertion-pressure conveyance
9. Hydraulic pump
10. Withdrawal-pressure tube

11. Withdrawal-pressure conveyance
12. Ground-line connector
13. Ground line
14. Ground position
15. Strand
16. Line
17. Attachment shaft
18. First jaw
19. Second jaw
20. Clamp chain
21. Chain tightener
22. Chain hook
23. Clamp-chain pin
24. Chain bracket
25. Tightener base
26. Tightener-bolt aperture
27. Tightener bolt
28. Adjustment nut
29. Pump cylinder
30. Pump piston
31. Lever arm
32. Pump base
33. Hydraulic reservoir
34. Reservoir-fluid conveyance
35. Control valve
36. Pump-outlet conveyance
37. Pivot gate
38. Central conveyance
39. Gate-end conveyance
40. Insertion-return channel
41. Withdrawal-return channel
42. Insertion-return conveyance
43. Withdrawal-return conveyance
44. Insertion-depth indicator
45. Indicator slot
46. Transmitter
47. Depth-indication receiver
48. Common ground Referring first to FIG. 1, a piercer blade 1 has an attachment end attached to a blade end of a double-acting hydraulic piston 2 in a double-acting hydraulic cylinder 3 from which a blade housing 4 is extended from a blade end of the double-acting hydraulic cylinder 3. A cable attachment such as a chain clamp 5 is positioned on a cable-attachment end of the blade housing 4 to hold an electric cable 6 rigidly while being pierced to conduct residual electrical current from the electric cable 6 in preparation for work on the electric cable 6.

An insertion-pressure tube 7 is in fluid communication intermediate an insertion-pressure end of the double-acting hydraulic cylinder 3 and an insertion-pressure conveyance 8 on a hydraulic pump 9. Oppositely disposed, a withdrawal-pressure tube 10 is in fluid communication intermediate a withdrawal-pressure end of the double-acting hydraulic cylinder 3 and a withdrawal-pressure conveyance 11 on the hydraulic pump 9. Insertion pressure forces the double-acting hydraulic piston 2, its related piston shaft and the piercer blade 1 in a direction of the electric cable 6 and withdrawal pressure provides withdrawal pressure in an opposite direction.

A ground-line connector 12, such as a wing nut and bolt depicted, is in electrical contact with the piercer blade 1 for conveying the residual current through a ground line 13 to a ground position 14. Electrical communication between the piercer blade 1 and the ground-line connector 12 can be through both ends of the double-acting hydraulic cylinder 3 being connected by a common ground 48 or other electrical conveyance.

Referring to FIGS. 1–4, the piercer blade 1 is sized and shaped to cut through and to provide effective electrical contact with a predetermined portion of strands 15 of either an electric cable 6 or multiple-line electric cable having multiple lines 16 as depicted in FIG. 2. This is accomplished with a piercer blade 1 having sufficient edge-to-edge width to encounter and to cut into at least a portion of three lines 16 of an integrated three-phase electric cable or through more lines 16 of single or multiple-phase electric cables 6. Side-to-side thickness is sufficiently less than the width to allow entry while also providing adequate material for structural integrity of the piercer blade 1.

Width-to-thickness ratio can be different for piercing electric cable 6 with different diameters. Longer piercer blades 1 for piercing larger cable 6 can be thinner in proportion to width and still have adequate structural integrity. Width, therefore can vary from two-to-six times thickness for different use conditions. Elliptical, oblong or round-edged rectangular cross sections of trunk portions of the piercer blades also can be employed. Between a tip and a trunk, the proportions can vary progressively for smooth-entry piercing.

Tips of the piercer blades are preferably arcuate and sharpened with cutting edges appropriate for predetermined blade material and cross-sectional structure.

Trunk or attachment ends of the piercer blades 1 are attached appropriately to an attachment shaft 17 of the double-acting piston 2.

The cable attachment such as the chain clamp 5 is oriented to retain the electric cable 6 with an axis of the electric cable 6 orthogonal to the width of the piercer blade 1 for cutting across a predetermined portion of the strands 15. The cable attachment is a cable clamp that is preferably the chain clamp 5 having a first jaw 18 attached to the blade housing 4 and a second jaw 19 oppositely disposed for pressing the first jaw 18 and the second jaw 19 against opposite sides of the electric cable 6. The electric cable 6 is maintained orthogonal to the width, which is colinear to the thickness of the piercer blade 1 by concave jaw surfaces having a predetermined length for rigid attachment.

The chain clamp 5 has at least one clamp chain 20, but preferably a pair of two of them, with a tightener end attached to a chain tightener 21 on a tightener side of the first jaw 18. A chain hook 22 on an oppositely disposed hook side of the first jaw 18 hooks clamp-chain pins 23 on which inside links and outside links of the clamp chain 20 pivot. An outside periphery of the second jaw 19 has a chain bracket 24 for retaining the second jaw 19 in proximity to the first jaw 18 while the electric-cable-grounding piercer is being maneuvered for clamping attachment and for retaining the clamp chain 20 in position in opposition to sliding contact of the clamp chain 20 with the second jaw 19.

The chain tightener 21 has a tightener base 25 with a tightener-bolt aperture 26 through which a tightener bolt 27 is extended. An adjustment nut 28 is threaded onto the tightener bolt 27 on a buttress side of the tightener base 25. The clamp chain 20 is attached to the tightener bolt 27 on a chain side of the tightener base 25.

The second jaw 19 can have a recess or slot to receive the tip of the piercer blade 1 for over-travel through the electric cable 6.

Figure 5:
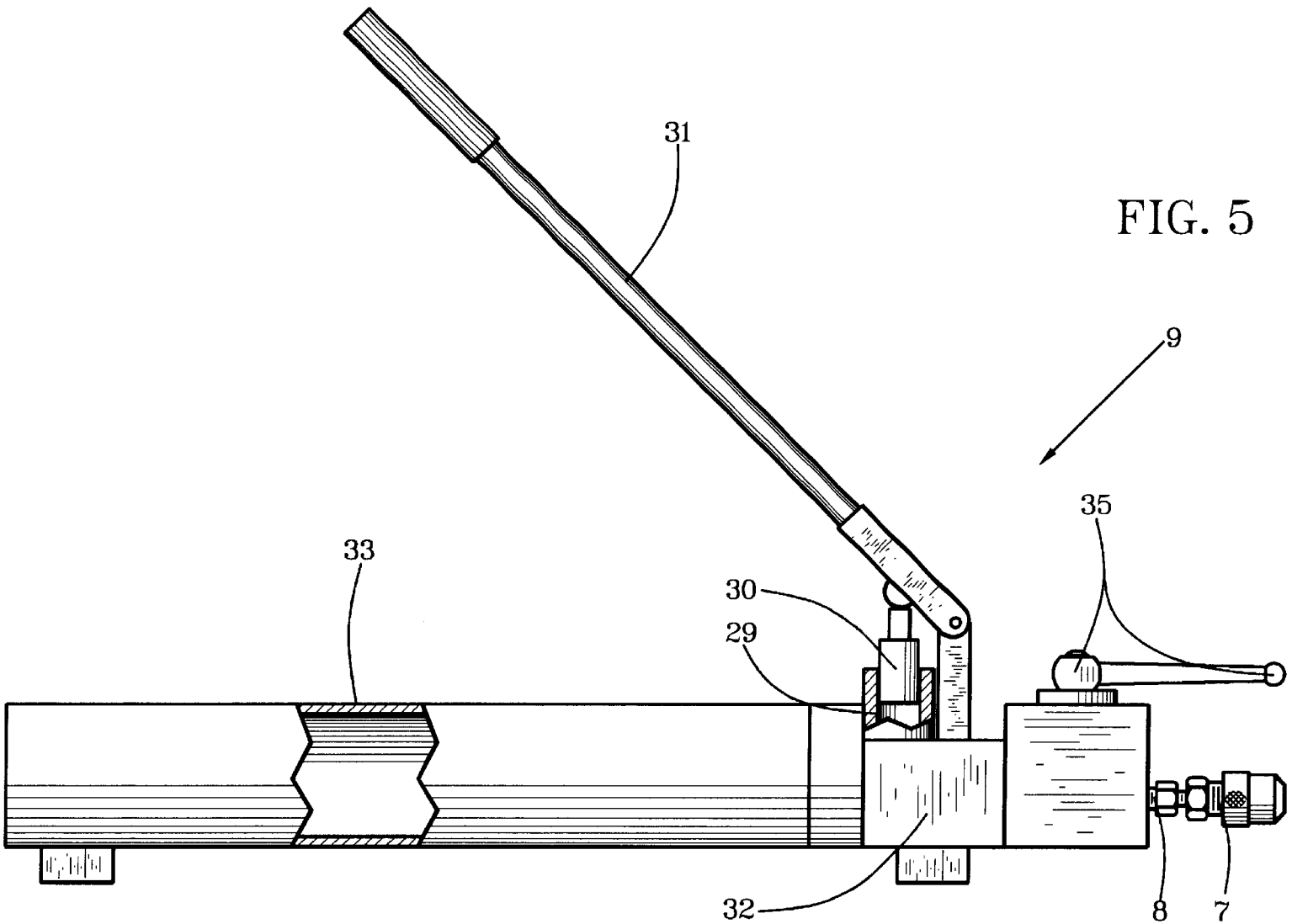
FIG. 5 is a partially cutaway side view of a hydraulic pump for the electric-cable-grounding piercer.
Figure 6:
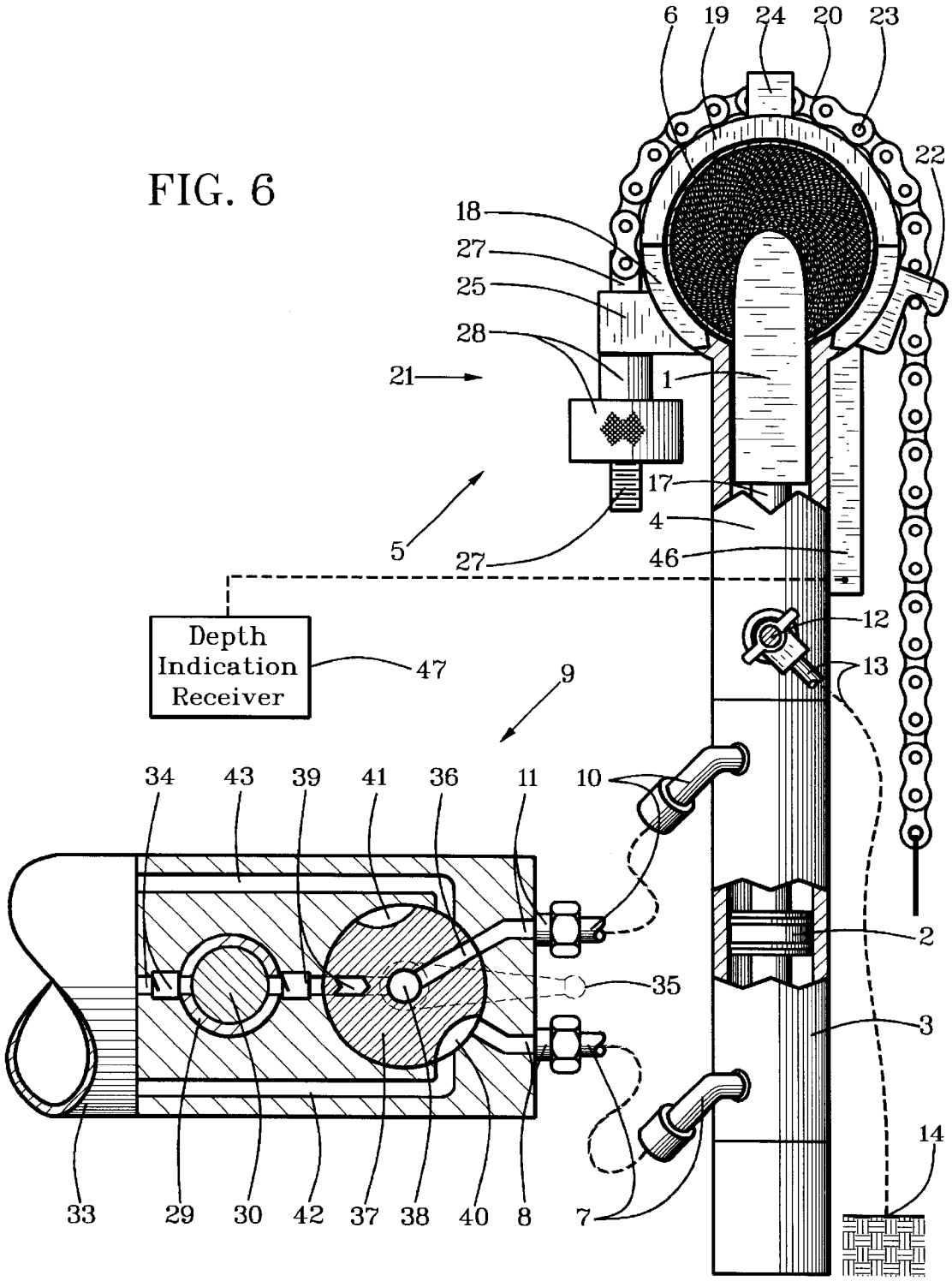
FIG. 6 is a partially cutaway plan view.

Referring to FIGS. 1 and 5–6, the preferred hydraulic pump 9 has a pump cylinder 29 in which a pump piston 30 is slidable by pressure from a lever arm 31 having a fulcrum end attached pivotally to a pump base 32 proximate which the pump cylinder 29 is positioned. The hydraulic pump 9 has a hydraulic reservoir 33 with a reservoir-fluid conveyance 34 in one-way-valved fluid communication from the hydraulic reservoir 33 to the pump cylinder 29. A control valve 35 has a pump-outlet conveyance 36 that is positioned in fluid communication intermediate the pump cylinder 29 and the insertion-pressure conveyance 8 or the withdrawal-pressure conveyance 11 selectively.

The control valve 35 has a pivot gate 37 in which the pump-outlet conveyance 36 is pivotal between communication with the insertion-pressure conveyance 8 and the withdrawal-pressure conveyance 11 selectively from a central conveyance 38 having a gate-end conveyance 39 that is in fluid communication with the pump cylinder 29 and the reservoir-fluid conveyance 34. For return flow of hydraulic fluid to the hydraulic reservoir 33, the pivot gate 37 has an insertion-return channel 40 on an insertion portion and a withdrawal-return channel 41 on a withdrawal portion of the pivot gate 37.

The insertion-return channel 40 is positioned to be in fluid communication intermediate an insertion-return conveyance 42 and the insertion-pressure conveyance 8 by pivot of the pivot gate 37 to position the pump-outlet conveyance 36 in communication with the withdrawal-pressure conveyance 11. This also positions the withdrawal-return channel 41 not to be in communication with a withdrawal-return conveyance 43.

Oppositely disposed on the pivot gate 37, the withdrawal-return channel 41 is positioned to be in fluid communication intermediate the withdrawal-return conveyance 43 and the withdrawal-pressure conveyance 11 by pivot of the pivot gate 37 to position the pump-outlet conveyance 36 in communication with the insertion-pressure conveyance 8. This also positions the insertion-return channel 40 not to be in communication with the insertion-return conveyance 42.

Fluid flow with this hydraulic pump 9 can be accomplished also with arrangements and combinations of known valves and flow controls which are foreseeable within this invention.

Figure 4:
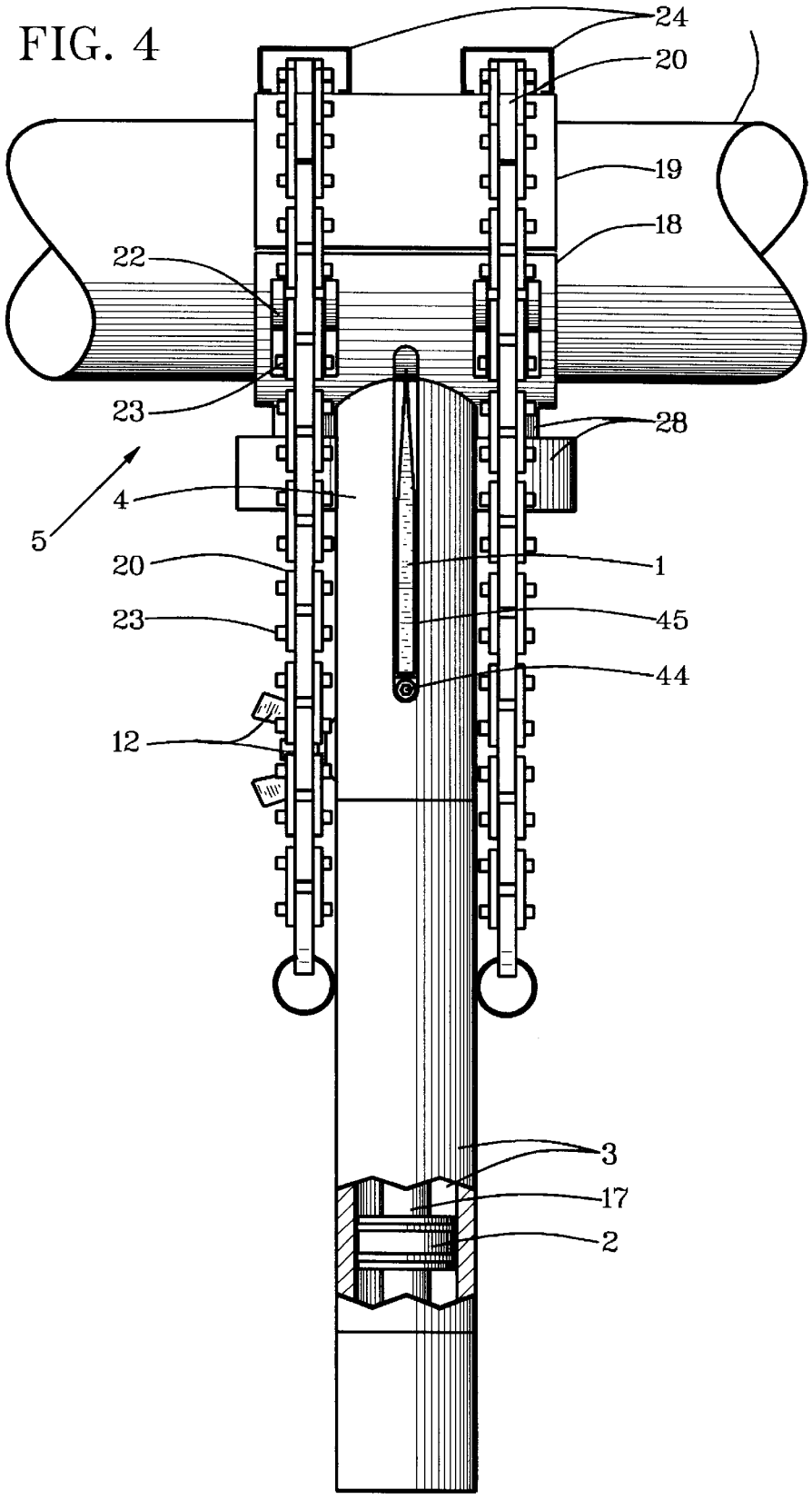
FIG. 4 is the FIG. 3 illustration from a left side.

Referring to FIGS. 4 and 6, an insertion-depth indicator 44 such as a socket bolt depicted in FIG. 4 can be attached to the trunk end of the piercer blade 1 to be seen through an indicator slot 45 for determining how deeply it has been driven into and how far it has been withdrawn from an electric cable 6. For remote control from proximity to the hydraulic pump 9 to high electric cables 6 being pierced, a transmitter 46 depicted in FIG. 6 can be employed to read and to transmit piercer-depth data to a depth indication receiver 47 proximate the hydraulic pump 9 or other control positions.

Further for operational and control factors, generic terms "IN" and "OUT" in relation to direction of actuation of the piercer blade 1 indicated on the hydraulic pump 9 in FIG. 1 can be replaced by trade terms or such terminology as communicates most effectively to workers using this electric-cable-grounding piercer. "PUNCH" can be used in place of "IN" and "RETURN" can be used in place of "OUT" for instance.

A new and useful electric-cable-grounding piercer having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An electric-cable-grounding piercer comprising:

a double-acting hydraulic piston in a double-acting hydraulic cylinder from which a blade housing is extended from a blade end of the double-acting hydraulic cylinder;

a piercer blade attached to a blade-attachment end of the double-acting hydraulic piston for being inserted momentarily into an electric cable to conduct residual electrical current from the electric cable in preparation for work on the electric cable;

a cable attachment on a cable-attachment end of the blade housing for rigid attachment of the electric-cable-grounding piercer to the electric cable;

an insertion-pressure tube in fluid communication intermediate an insertion-pressure end of the double-acting hydraulic cylinder and an insertion-pressure conveyance on a hydraulic pump;

a withdrawal-pressure tube in fluid communication intermediate a withdrawal-pressure end of the double-acting hydraulic cylinder and a withdrawal-pressure conveyance on the hydraulic pump; and a ground-line connector proximate the blade housing.

2. The electric-cable-grounding piercer as described in claim 1 wherein:

the piercer blade is sized and shaped to cut through and to provide effective electrical contact with a predetermined portion of strands of predetermined cable.

3. The electric-cable-grounding piercer as described in claim 1 wherein:

the piercer blade has an arcuate leading edge with a predetermined curvature and sharpness for cutting and wedging against wire strands of the predetermined cable.

4. The electric-cable-grounding piercer as described in claim 1 wherein:

the piercer blade has a trunk section with a cross section having a width between two sides larger than a thickness of the two sides of the trunk section.

5. The electric-cable-grounding piercer as described in claim 4 wherein:

the piercer blade has a tip that is elliptical with progressively larger width in proportion to thickness from a direction of the tip to the trunk section; and the trunk section is about one-third-to-one-fourth of a distance from the tip to an attachment end of the piercer blade.

6. The electric-cable-grounding piercer as described in claim 4 wherein:

the width of the trunk section is about three-to-six times the thickness of the two sides of the trunk section.

7. The electric-cable-grounding piercer as described in claim 4 wherein:

the cable attachment is oriented to retain the electric cable with an axis of the electric cable orthogonal to the width of the piercer blade.

8. The electric-cable-grounding piercer as described in claim 1 wherein:

the cable attachment is a cable clamp having a first jaw attached to the blade housing and a second jaw oppositely disposed for pressing the first jaw and the second jaw against opposite sides of the electric cable;

the first jaw has an concave surface with a predetermined length orthogonally to the blade housing and orthogonally to the width of the piercer blade for being pressed against a first side of the electric cable; and the second jaw has a concave surface with a predetermined length orthogonally to the blade housing and orthogonally to a width of the piercer blade for being pressed against a second side of the electric cable.

9. The electric-cable-grounding piercer as described in claim 8 wherein:

the cable clamp is a chain clamp having at least one clamp chain with a tightener end attached to a chain tightener on a tightener side of the first jaw;

the first jaw has a chain hook on a hook side of the first jaw for anchoring the clamp chain to the first jaw for forcing the first jaw and the second jaw together with the electric cable between them; and the second jaw has a chain bracket on an outside periphery for retaining the second jaw in proximity to the first clamp while the electric-cable-grounding piercer is being maneuvered for clamping attachment and for retaining the clamp chain in position in opposition to sliding contact of the clamp chain with the second jaw.

10. The electric-cable-grounding piercer as described in claim 9 wherein:

the chain tightener has a tightener base with a tightener-bolt aperture through which a tightener bolt is extended;

an adjustment nut is threaded onto the tightener bolt on a buttress side of the tightener base; and the clamp chain is attached to the tightener bolt on a chain side of the tightener base.

11. The electric-cable-grounding piercer as described in claim 1 wherein:

the ground-line connector is a conductor bolt onto which is threaded a connector nut proximate the blade housing.

12. The electric-cable-grounding piercer as described in claim 1 wherein:

the hydraulic pump has a pump cylinder in which a pump piston is slidable by pressure from a lever arm having a fulcrum end attached pivotally to a pump base proximate which the pump cylinder is positioned;

the hydraulic pump has a hydraulic reservoir with a reservoir-fluid conveyance in one-way-valved fluid communication from the hydraulic reservoir to the pump cylinder; and the hydraulic pump has a control valve with a pump-outlet conveyance that is positioned in fluid communication intermediate the pump cylinder and the insertion-pressure conveyance or the withdrawal-pressure conveyance selectively.

13. The electric-cable-grounding piercer as described in claim 12 wherein:

the hydraulic pump has an insertion-return conveyance in fluid communication intermediate the insertion-pressure conveyance and the hydraulic reservoir and the hydraulic pump has a withdrawal-return conveyance in fluid communication intermediate the withdrawal-pressure conveyance and the hydraulic reservoir selectively.

14. The electric-cable-grounding piercer as described in claim 13 wherein:

the withdrawal-return conveyance is positioned in fluid communication with the hydraulic reservoir and the insertion-return conveyance is positioned not to be in fluid communication with the hydraulic reservoir by positioning of the pump-outlet conveyance to be in fluid communication with the insertion-pressure conveyance; and the insertion-return conveyance is positioned in fluid communication with the hydraulic reservoir and the withdrawal-return conveyance is positioned not to be in fluid communication with the hydraulic reservoir by positioning of the pump-outlet conveyance to be in fluid communication with the withdrawal-pressure conveyance.

15. The electric-cable-grounding piercer as described in claim 14 wherein:

the control valve has a pivot gate in which the pump-outlet conveyance is pivotal between communication with the insertion-pressure conveyance and the withdrawal-pressure conveyance selectively from a central conveyance having a gate-end conveyance in fluid communication with the pump cylinder and the reservoir-fluid conveyance;

the pivot gate has an insertion-return channel on an insertion portion and a withdrawal-return channel on a withdrawal portion of the pivot gate;

the insertion-return channel is positioned to be in fluid communication intermediate the insertion-return conveyance and the insertion-pressure conveyance by pivot of the pivot gate to position the pump-outlet conveyance in communication with the withdrawal-pressure conveyance and to position the withdrawal-return channel not to be in communication with the withdrawal-return conveyance; and the withdrawal-return channel is positioned to be in fluid communication intermediate the withdrawal-return conveyance and the withdrawal-pressure conveyance by pivot of the pivot gate to position the pump-outlet conveyance in communication with the insertion-pressure conveyance and to position the insertion-return channel not to be in communication with the insertion-return conveyance.

16. The electric-cable-grounding piercer as described in claim 1 and further comprising:

an insertion-depth indicator attached to the piercer blade proximate attachment of the piercer blade to the double-acting hydraulic piston.

17. The electric-cable-grounding piercer as described in claim 16 and further comprising:

a control valve on the hydraulic pump; and a communicator in communication intermediate the insertion-depth indicator and a remote position proximate the hydraulic pump for feedback control of insertion of the piercer blade into and withdrawal of the piercer blade out from the electric cable remotely from the electric cable.

18. An electric-cable-grounding piercer comprising:

a piercer blade attached to a double-acting hydraulic piston in a hydraulic cylinder on a piercer housing having a cable clamp with concave clamp jaws having axes of jaw concavity oriented to retain an electric cable with a cable axis orthogonal to a piercer-blade width that is larger than a thickness of the piercer blade;

the piercer blade being sized and shaped to cut and to be in electrical contact momentarily with a predetermined portion of strands of the electric cable for electrical grounding in preparation for work on the electrical cable;

a hydraulic pump having bidirectional hydraulic pressure generation for pressure-insertion of the piercer blade into and for pressure-withdrawal of the piercer blade out from the electric cable selectively; and a ground-line connector having electrical communication with the piercer blade.

19. The electric-cable-grounding piercer as described in claim 18 and further comprising:

an insertion-depth indicator attached to the piercer blade proximate attachment of the piercer blade to the double-acting hydraulic piston.

20. The electric-cable-grounding piercer as described in claim 19 and further comprising:

a control valve on the hydraulic pump; and a communicator in communication intermediate the insertion-depth indicator and a remote position proximate the hydraulic pump for feedback control of insertion of the piercer blade into and withdrawal of the piercer blade out from the electric cable remotely from the electric cable.

* * * * *